US005184724A

United States Patent [19]

Mayled

[11] Patent Number: 5,184,724

[45] Date of Patent: Feb. 9, 1993

[54] FLEXIBLE PACKAGE FOR SMALL ITEMS

[76] Inventor: Edward C. Mayled, 3131 Merritt Avenue, Malton, Ontario, Canada, L4T 1P4

[21] Appl. No.: 298,632

[22] Filed: Jan. 18, 1989

Related U.S. Application Data

[63] Continuation-in-part of Ser. No. 101,590, Sep. 28, 1987, abandoned.

[51] Int. Cl.[5] ..... B65D 30/10; B65D 73/00

[52] U.S. Cl. ..... 206/466; 206/471; 206/806; 383/9; 383/38; 493/926

[58] Field of Search ..... 206/461, 466, 471, 806, 206/45.31, 45.33, 45.34; 383/9, 38, 40, 106, 107; 493/222, 226, 926

[56] References Cited

U.S. PATENT DOCUMENTS

| | | | |
|---|---|---|---|
| 3,175,553 | 3/1965 | Mattson | 383/38 X |
| 3,198,329 | 8/1965 | Golenpaul et al. | 206/486 X |
| 3,334,804 | 8/1967 | Watts, Jr. | 206/466 X |
| 3,503,492 | 3/1970 | Marsh | 383/38 X |
| 3,613,680 | 10/1971 | Zamarra | 609/262 X |
| 3,638,784 | 2/1972 | Bodolay et al. | 383/38 X |
| 3,974,957 | 8/1976 | Benzon-Petersen | 206/466 X |
| 4,478,386 | 10/1984 | Mikkelsen | 383/107 X |
| 4,674,128 | 6/1987 | Ruff | 383/38 X |

FOREIGN PATENT DOCUMENTS

| | | | |
|---|---|---|---|
| 0275350 | 7/1988 | European Pat. Off. | 206/806 |
| 2044218 | 10/1980 | United Kingdom | 383/9 |
| 1589273 | 5/1981 | United Kingdom | 206/806 |

*Primary Examiner*—Bryon P. Gehman
*Attorney, Agent, or Firm*—Bachman & LaPointe

[57] ABSTRACT

A flexible, transparent package comprises a pouch with a pouch cavity defined between opposed walls of the pouch, and a pouch opening for access to the interior; opposed portions of the walls are connected together to form a compartment within the pouch cavity; the compartment is suitably located centrally within the pouch cavity to provide a better display of the product housed by the package.

8 Claims, 6 Drawing Sheets

FLEXIBLE PACKAGE FOR SMALL ITEMS

CROSS-REFERENCE TO RELATED APPLICATIONS

This application is a continuation-in-part of U.S. patent application Ser. No. 101,590 filed Sep. 28, 1987, now abandoned.

BACKGROUND OF THE INVENTION i) Field of the Invention

This invention relates to packaging and more especially to a transparent, flexible package, its method of manufacture and an apparatus for such manufacture.

ii) Description of Prior Art

Transparent, flexible packaging in the form of bags or pouches is well known. Such bags or pouches are employed for display and sale of small items employed by the handyman in the home, such as fuses, electrical splices and connectors, and screws, and by the homemaker in homecrafts, for example, buttons and thread.

Typically the bag or pouch contains a plurality of these discrete small items, such as screws, which are mobile within the bag or pouch and congregate in a disordered, random manner in the lowermost part of the bag or pouch when the latter is hung vertically. The discrete items usually occupy only a small volume of the bag volume and are thus mobile within the bag if the disposition of the bag is changed.

The transparent material, typically plastic sheet, employed to fabricate the bag or pouch enables the contents of the bag to be viewed and checked by the purchaser, prior to purchase.

The open end of each bag includes a closure device or arrangement to prevent ready access to the bag and reduce pilfering. Typically the bag may be surrounded by a folded card member which is secured to the bag, which card member has a punched hole by means of which the bag can be hung on a rack for in-store display. Alternatively, the whole bag may be received in a card envelope having an opening in a front envelope wall for display of the bag contents. In such case the envelope has a punched hole for hanging of the envelope containing the bag.

The bag typically has a volume capacity significantly larger than the total volume of the small items. The size of the bag is selected to facilitate handling and to support labelling and promotional material as well as product literature.

Thus, for example, a bag dimensioned solely to tightly contain 3 or 4 screws, electrical fuses or similar items would be inconveniently small for handling and would be unable to adequately support labelling and promotional material or product literature.

This disparity between the size or volume capacity of the bag or pouch and the volume of the small items to be housed results in disadvantages with respect to the display of the items.

Thus in the prior arrangements the discrete small items fall to the bottom of the hanging bag so that they are not well displayed. In addition the collection of the small items together in the bottom of the bag makes the bottom of the bag bulky, thus decreasing the number of bags which can be hung vertically, in a tidy manner, from the hook of a display rack.

In addition, product literature, for example, an instruction sheet, is often included in the bag, and this also falls to the bottom of the hanging bag diminishing the effectiveness of the point of sale display.

It would be advantageous if the small discrete items could be isolated or confined in an orderly, compact, less bulky arrangement in a central zone of the bag for better display, with reduced mobility within the bag, and if product literature within the bag could be isolated from the small items.

One approach to a more orderly central arrangement of discrete, small items is the blister pack which employs a relatively rigid, non-flexible, transparent dome mounted on a card. A housing for the small items is thus defined between the card and the transparent dome. The dome can be disposed centrally on the card, and the small items occupy the space provided by the housing without distorting the non-flexible dome.

Blister packages are costly to manufacture, difficult to open without destroying them, and are not susceptible to being re-used for storage of the small items which are not needed, for future use.

SUMMARY OF THE INVENTION

It is an object of this invention to provide a package which overcomes disadvantages associated with prior packages, and to provide a method and apparatus for manufacture of such a package.

It is a particular object of the invention to provide a package in the form of a flexible, transparent pouch which has an inner compartment for small items isolated within the pouch cavity, more especially isolated in a central part of the pouch cavity.

In accordance with one aspect of the invention there is provided a package comprising: a flexible pouch having a pouch opening communicating with a pouch cavity, opposed portions of said pouch being connected to form at least one compartment within said pouch cavity, said at least one compartment being in access communication with said pouch opening.

In accordance with another aspect of the invention there is provided a method of producing a package comprising: providing at least one flexible sheet, forming a flexible pouch enclosure from said at least one sheet, said pouch enclosure having a pair of opposed walls connected together at opposed outer edges to define a pouch cavity, connecting opposed portions of said opposed walls together to form at least one compartment within said pouch cavity, and providing a pouch opening for said pouch cavity, communicating with said at least one compartment.

In accordance with still another object of the invention there is provided an apparatus for producing packages comprising: aligning means for aligning a pair of elongate wall-forming zones of plastic, flexible sheet material in opposed facing relationship, first sealing means for sealing the opposed wall-forming zones at spaced apart sealing zones of each wall-forming zone of said pair to form a plurality of pouch enclosures of the flexible sheet material, in side-by-side relationship, and second sealing means for sealing opposed portions of the opposed wall-forming zones between adjacent sealing zones to form at least one compartment within each pouch enclosure of said plurality.

DESCRIPTION OF PREFERRED EMBODIMENTS WITH REFERENCE TO THE DRAWINGS

Figure 1:
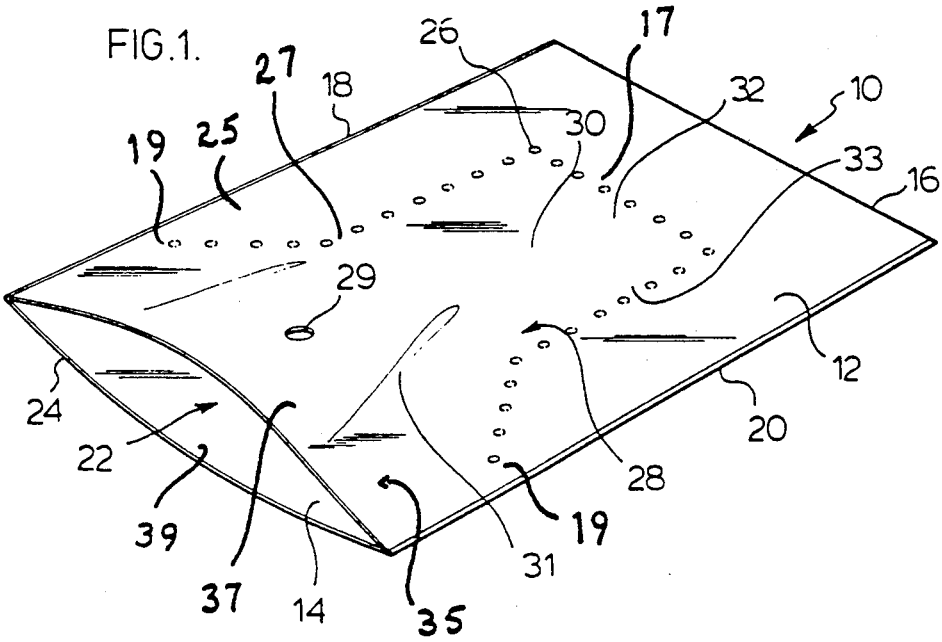
FIG. 1 is a perspective view of an open pouch in accordance with the invention.

With further reference to FIG. 1, a pouch 10 of flexible, transparent sheet material, particularly of plastic, for example polyvinyl chloride, has a front wall 12, a rear wall 14 and a fold 16. Front and rear walls 12 and 14 are sealed together along sealed edges 18 and 20.

A pouch cavity 22 is formed between walls 12 and 14, sealed edges 18 and 20 and fold 16. Pouch 10 has a pouch opening 24 providing access to cavity 22. A hanging hole 29 extends through walls 12 and 14.

A plurality of pin hole welds 26 directly connects front and rear walls 12 and 14, respectively, defining a compartment 28 within pouch cavity 22 in a central zone 30 of pouch 10; the compartment being bounded by an outer zone 25 of pouch cavity 22, in which walls 12 and 14 are not sealed together.

The pin hole welds 26 are in closely spaced apart relationship, with a spacing 27 between each pair of adjacent pin hole welds 26. The spacing 27 is sufficiently short that outer zone 25 is isolated from the compartment 28 and discrete small items housed in compartment 28 are confined within central zone 30 and unable to pass through spacing 27 to outer zone 25.

It will be recognized that the spacings 27 may be considered as defining small passages between outer zone 25 and central zone 30 inasmuch as walls 12 and 14 are not sealed together at spacings 27. The dimensions of the spacings 27 are chosen so that such passages are too narrow for passage of the discrete small items to be housed in compartment 28 from compartment 28 to outer zone 25.

Compartment 28 has an entry port 31 in communication with pouch opening 24 whereby compartment 28 is accessible from pouch opening 24. Entry port 31 is funnel-shaped and may be considered as having an inverted, frusto-conical wall 35 defined by opposed half-funnel walls 37 and 39. The funnel shape of opening 31 is achieved by a pair of converging rows 19 of pin hole welds 26, converging towards central zone 30 from sealed edges 18 and 20, respectively.

Compartment 28 has opposed compartment walls 32 and 33 defined by portions of the front and rear walls 12 and 14, respectively, and a floor edge defined by a row 17 of the pin hole welds 26, and is spaced from sealed edges 18 and 20, fold 16 and pouch opening 24. The row 17 is in opposed spaced apart relationship with fold 16.

The funnel shape of entry port 31 facilitates introduction of mobile, discrete small items into compartment 28; the slope resulting from converging rows 19 being such that discrete small items introduced usually by free-falling introduction under gravity, at pouch opening 24, slide or tumble along the frusto-conical wall 35 into compartment 28.

Compartment 28 and its entry port 31 are of essentially symmetrical shape and located within pouch cavity 22 so as to extend centrally of pouch 10.

Figure 2:
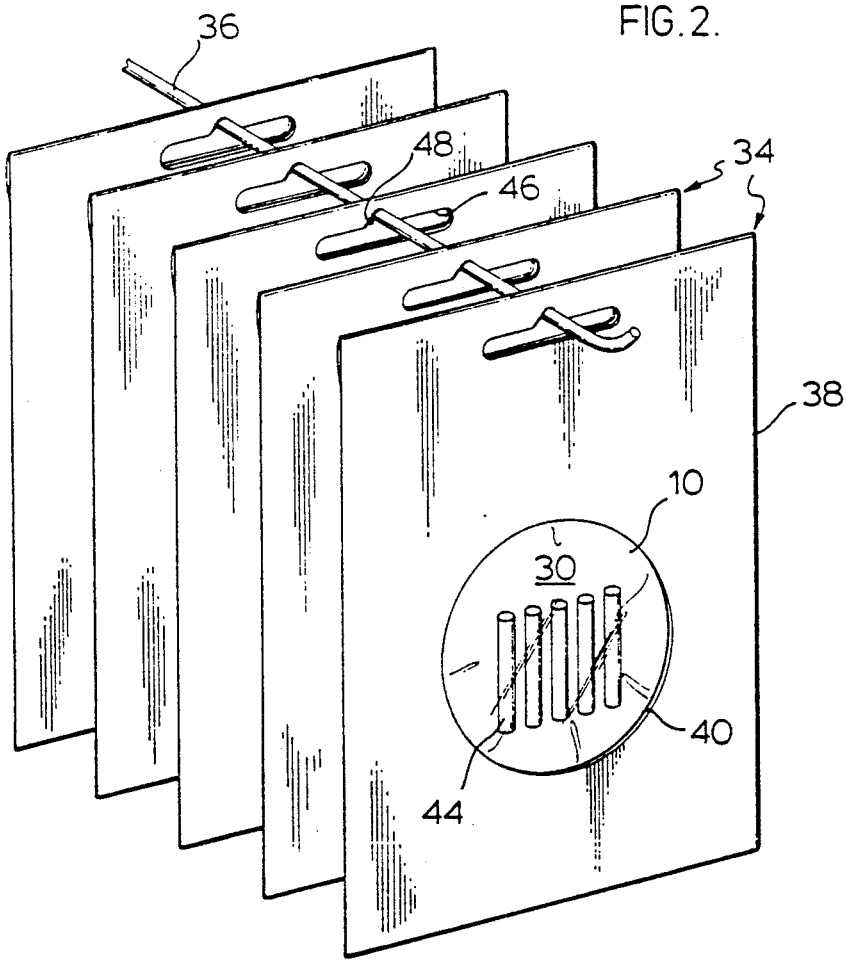
FIG. 2 is a perspective view of an assembly of packages of the invention on a display rack.

With further reference to FIG. 2, a plurality of packages 34 hang from a display hook 36.

Each package 34 comprises a display envelope 38 housing a pouch 10 as illustrated in FIG. 1. Display envelope 38 includes a display opening 40 whereby the central zone 30 and the compartment 28 of pouch 10 are visible such that small items 44 in compartment 28 are displayed.

Display envelope 38 includes a slot 46 having a hook-retaining channel 48 whereby the package 34 can be neatly hung from hook 36.

Figure 3:
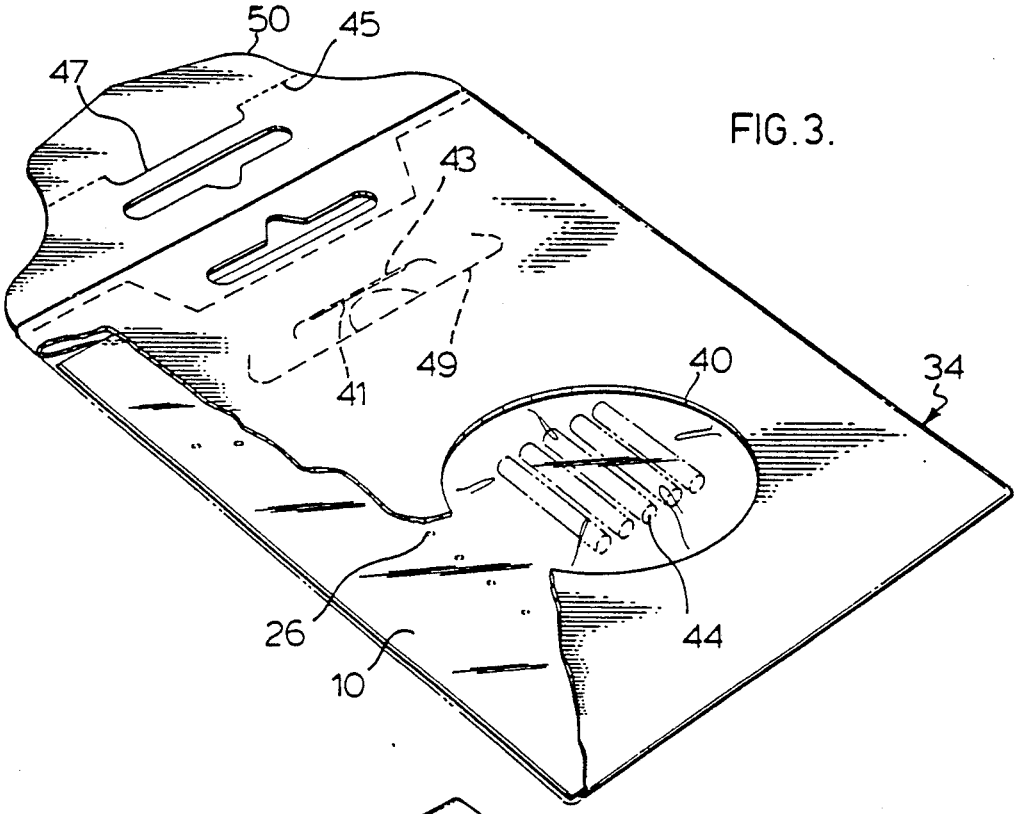
FIG. 3 is a perspective view of a package of the assembly of FIG. 2, part cut-away.

With further reference to FIG. 3, there is shown a package 34 of FIG. 2, with part cut-away to show the component parts, namely, the display envelope 38 and pouch 10. Display envelope 38 has a closure flap 50 received in a slot 49 in a rear wall 53 of display envelope 38, to close package 34.

FIG. 3 also illustrates a variation in which flap 50 has a fold line 45 therein with a cut-out projection 47 interrupting fold line 45. A cut line 43 in rear wall 53 defines a slot 41 to receive projection 47 to close package 34. In this variation slot 49 can be omitted.

Figure 4:
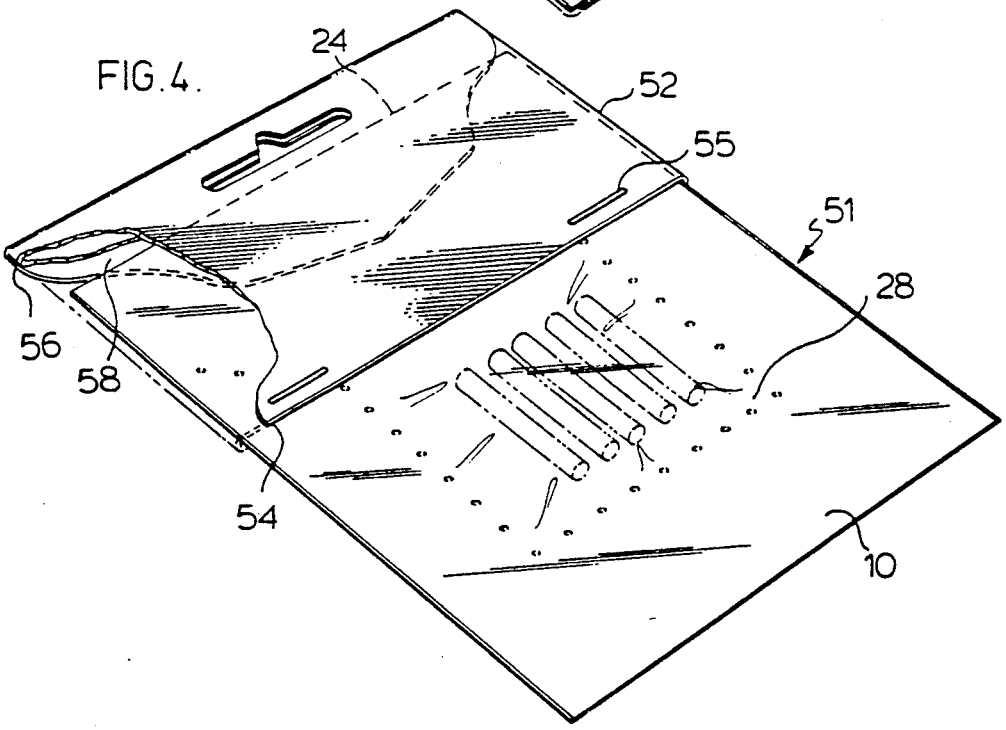
FIG. 4 is a perspective view of a different package of the invention, part cut-away.

With further reference to FIG. 4, a package 51 includes a display card 52 and a pouch 10 of FIG. 1.

Display card 52 forms a tubular housing including a lower open end 54 and an upper open end 56. A closure flap 58 functions similarly to the closure flap 50 of display envelope 38 to close open end 56. The display card 52 is secured in any convenient manner, for example, by metal staples 55, to pouch 10, adjacent lower open end 54.

A feature of package 51 and also of package 34 of FIG. 3, is that access to the pouch 10 is provided without removing pouch 10 from display card 52, or envelope 38. Thus by opening flap 58 of package 51 access may be had to pouch opening 24 and thence to the contents of compartment 28 without the need to remove pouch 10 from display card 52. This might be disadvantageous in large self-service stores from a security standpoint, but represents a convenience for the purchaser.

Figure 5:
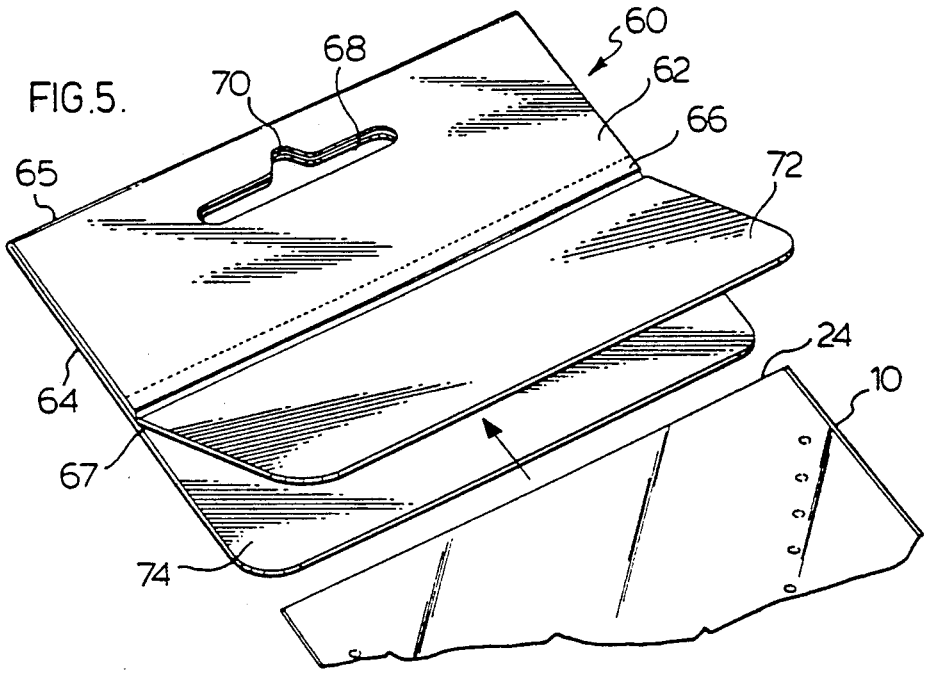
FIG. 5 is a perspective view of a card member of the invention suitable for mounting the pouch of FIG. 1.

With further reference to FIG. 5, a card member 60 comprises a front panel 62 and a rear panel 64 joined at a fold 65. Front and rear panels 62 and 64 are adhered together along a zone of adhesion 66 to form an inner abutment 67.

A slot 68 having a channel 70 extends through front and rear panels 62 and 64, the purpose of which is the same as at slot 46 and channel 48 of package 34.

A front panel flap 72 extends from front panel 62 and a rear panel flap 74 extends from rear panel 64.

A pouch 10 of FIG. 1 can be located with its upper end containing pouch opening 24 between the front and rear panel flaps 72 and 74, respectively, adjacent abutment 67, the panel flaps 72 and 74 then being secured together for example by means of staples, with the upper end of pouch 10 held therebetween. Thereafter the resulting package can be hung from a display hook 36 as for the packages 34 of FIG. 2.

Figure 6:
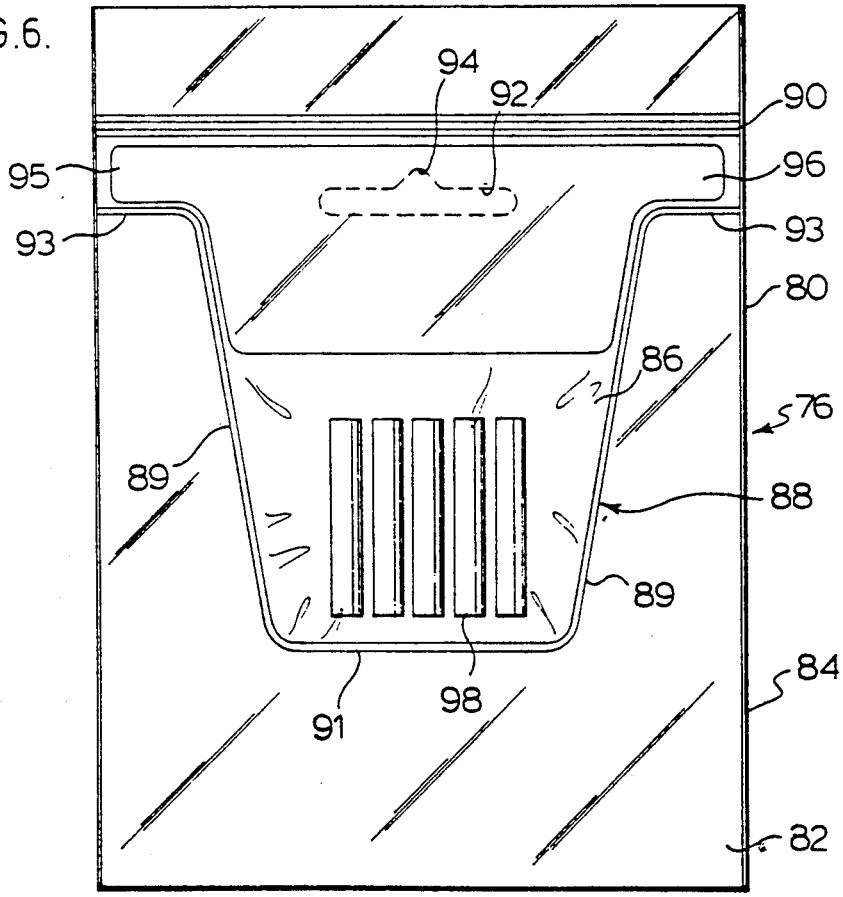
FIG. 6 is a front elevation of yet another package of the invention.

With further reference to FIG. 6, a package 76 includes a pouch 78 having a pouch cavity 80. Pouch cavity 80 is defined between a front wall 82 and a rear wall 84. A weld line 88 between opposed portions of front and rear walls 82 and 84 respectively defines an inner compartment 86 contained within pouch cavity 80.

Package 76 includes a closure 90 in front wall 82 of a conventional kind. Closure 90 may typically comprise an elongate channel formed in rear wall 84 and an elongate rib formed in front wall 82 in opposed relationship with the elongate channel; the elongate rib being matingly and sealingly received in the elongate channel. Closure 90 can be opened to provide access to inner compartment 86 and can be resealed, as desired.

A slot 92 having a channel 94 is formed in an upper end of package 76 and functions in similar manner to slot 46 and channel 48 of package 34.

It will be observed that side weld lines 89 of weld line 88 converge to a bottom weld line 91 at the bottom end of compartment 86, and that weld line 88 includes a pair of shelf weld lines 93 at an upper end of compartment 86.

The converging weld lines 89 function similarly to the converging rows 19 of entry port 31 in FIG. 1, to facilitate free-fall flow of discrete small items into inner compartment 86.

Product literature 96 which specifically may be in the form of a die cut card is shaped so as to be received in an upper part of compartment 86 with ears 95 of literature 96 resting on shelf weld line 93.

The shelf weld lines 93 are, in particular, sufficiently short that small items falling into compartment 86 do not rest on shelf weld 93 but bounce or tumble into compartment 86.

A small item 98 is housed within compartment 86 below product literature 96.

As shown in dotted line, slot 92 and channel 94 may, in a variation, be formed through product literature 96 and walls 82 and 84. This variation may be especially advantageous if the small items 98 are relatively heavy since the slot and channel formation in the card of product literature 96 provide support.

Figure 7:
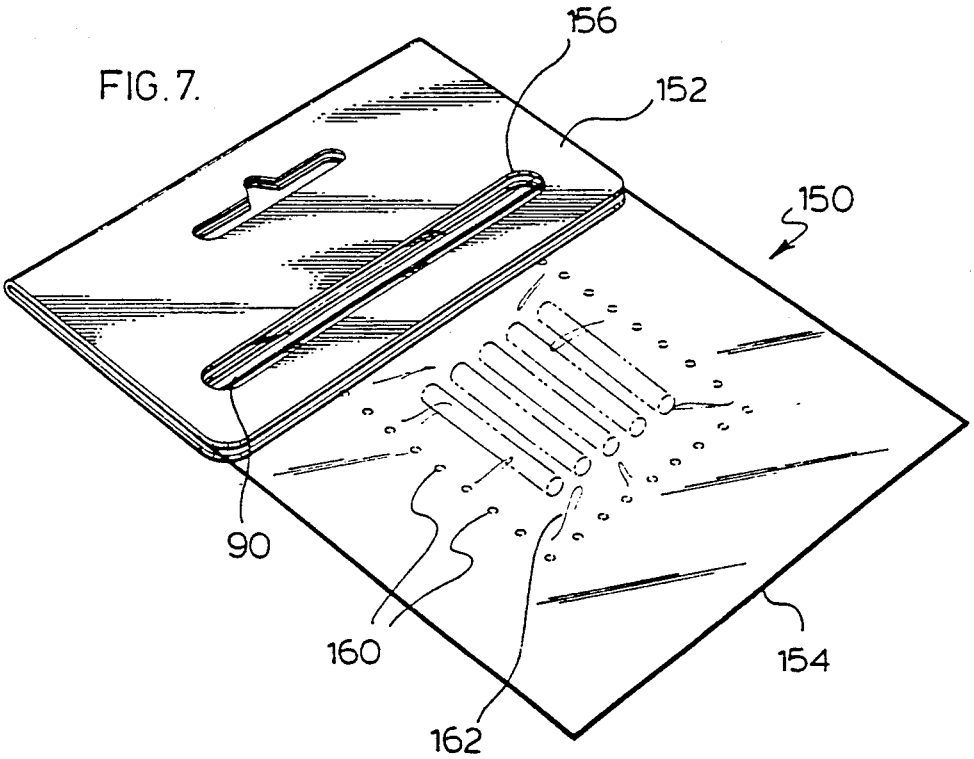
FIG. 7 is a front elevation of still another package of the invention.

With further reference to FIG. 7, a package 50 includes a card member 152 and a pouch 154. Card member 152 is similar to card member 60 of FIG. 5 but has an elongate window 156 therein. Pouch 154 is similar to pouch 78 of FIG. 6 in having a closure 90 of conventional kind as described with reference to FIG. 6.

Pouch 154 is of flexible, transparent sheet material and has a pouch cavity 158 formed between opposed walls of the pouch 154. A plurality of pin hole welds 160 directly connects the opposed walls to define a compartment 162 generally centrally within pouch cavity 158.

The window 156 permits the closure 90 to be viewed and the card member 152 prevents improper opening of closure 90.

Figure 8:
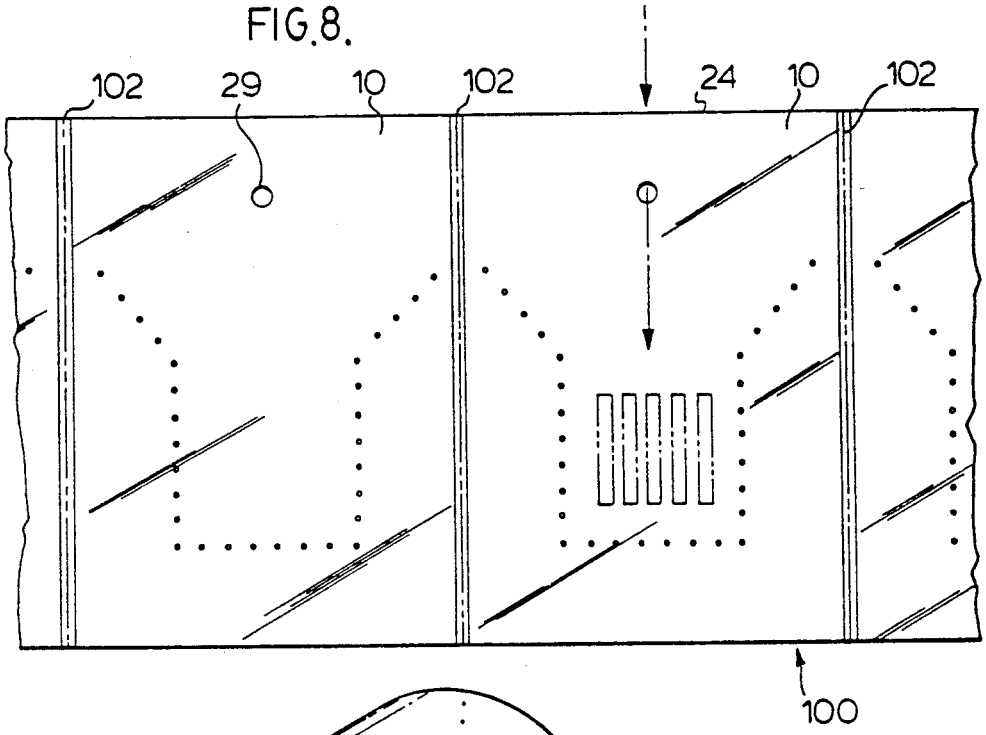
FIG. 8 shows a strip of pouches in accordance with the invention.

With further reference to FIG. 8, there is shown a strip 100 of the pouches 10 of FIG. 1.

Strip 100 includes a plurality of spaced apart sealing zones 102. It will be understood that individual pouches 10 may be separated from strip 100 at any convenient time either before or after introduction of product into compartment 28, for example, by cutting through sealing zones 102 between adjacent pouches 10.

Figure 9:
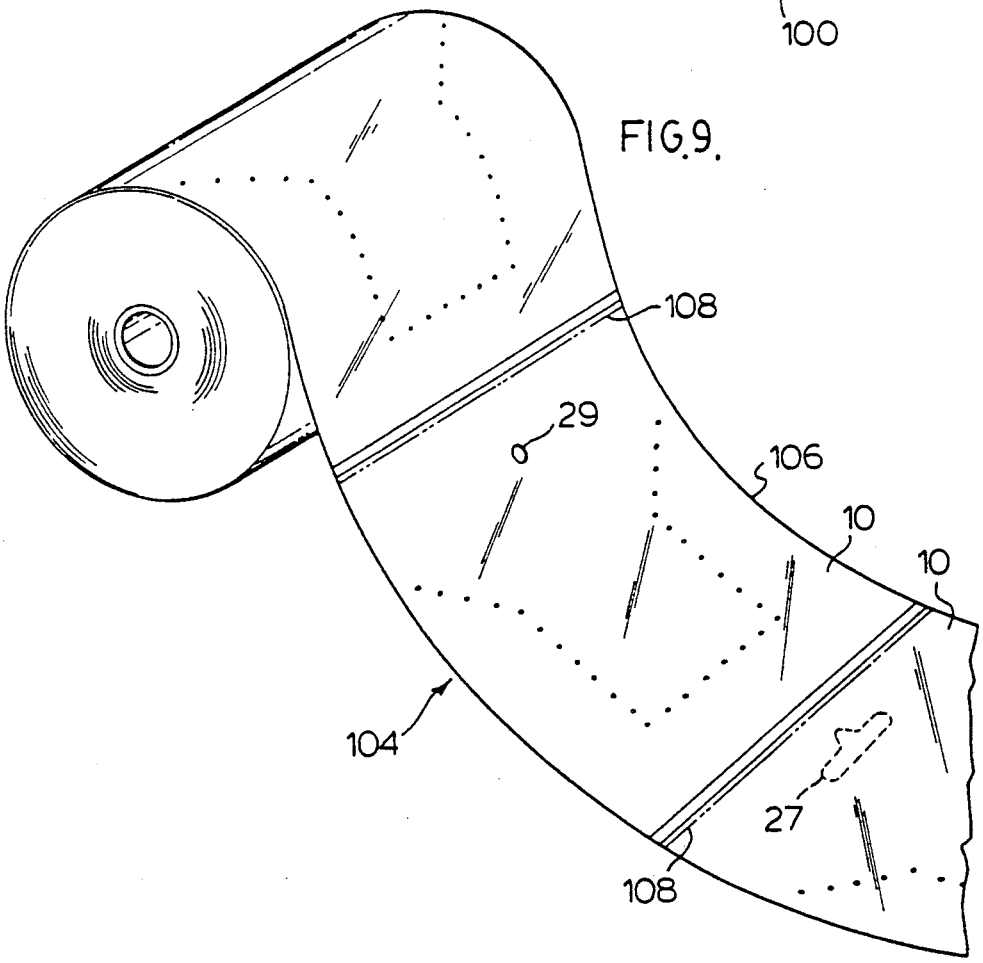
FIG. 9 shows a perspective view of a roll of pouches in a different embodiment of the invention.

With further reference to FIG. 9, there is shown a roll 104 comprising a strip 106 of pouches 10; the strip 106 being different from the strip 100 of FIG. 7.

The pouches 10 may include hanging holes 29 or hanging slots 27.

Perforations 108 extend laterally of strip 106 between adjacent pouches 10 whereby individual pouches 10 can be readily separated from strip 106.

Figure 10:
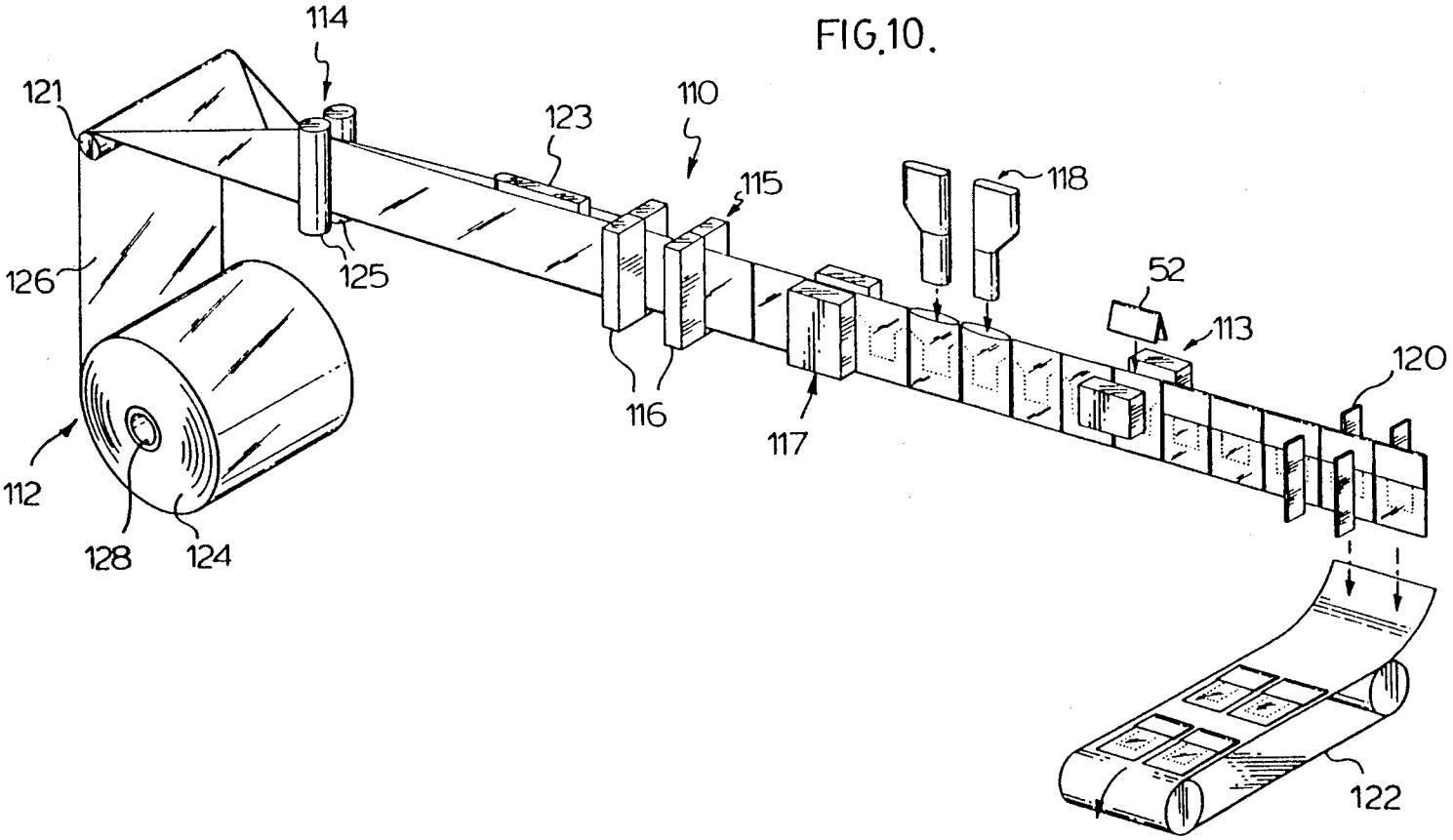
FIG. 10 illustrates schematically an apparatus and method for continuous production of pouches as shown in FIG. 1.

With further reference to FIG. 10, assembly 110 includes a sheet supply 112, a folding station 114, a pouch welding station 115, a compartment welding station 117, a supply hopper 118, a display card mounting station 113 and cutters 120.

Sheet supply 112 includes a roll 124 of sheet material 126 mounted on reel 128 which suitably is a motorized reel.

Folding station 114 comprises a horizontal roll 121 and a pair of vertical rolls 125.

A guide 123 is disposed upstream of pouch welding station 115 which includes a pair of vertical soldering pincers 116.

A conveyor 122 is disposed below cutters 120.

In operation sheet material 126 is fed from roll 124 over roll 121 and between vertical rolls 125 of folding station 114, whereby sheet material 126 is folded longitudinally to form a pair of elongate wall-forming zones 130.

The elongate wall-forming zones 130 are separated by guide 123 upstream of vertical soldering pincers 116 which weld spaced apart sealing zones 132 between the elongate wall-forming zones to define pouch enclosures 134, each of which has an opening 140.

Compartment welding station 117 forms a weld between opposed portions of each pouch enclosure 134 to form a weld 136 which defines an inner compartment 138 within each pouch enclosure 134 whereafter product is introduced through opening 140 from supply hopper 118 into inner compartment 138.

A display card such as 52 of FIG. 4 is applied about opening 140 and the upper part of each pouch enclosure 134 at display card station 113.

Individual packages are separated by cutters 120 and fall onto conveyor 122.

It will be understood that various modifications can be made in the assembly 110, for example, the pouch welding station 115 and the compartment welding station 117 may form a single station with the pouch enclosures 134 and compartments 138 being formed simultaneously.

Concerning the pin hole welds 26 in the embodiment of FIG. 1, it will be understood that the welds 26 are spaced sufficiently close by spacing 27 that small objects housed in compartment 28 will not escape between adjacent pin hole welds 26 to the outer zone 25 surrounding or bounding compartment 28.

The packages of the invention are particularly designed to house a plurality of small discrete items in which the individual discrete items each has a volume significantly less than the volume of the compartment of the package in which the items are housed, and the compartment itself has a volume less than that of the bag or pouch cavity of the package within which it is formed. The otherwise mobile discrete items are located generally centrally of the bag or pouch cavity of the package; the mobility of the items being restricted insofar as they are confined to the compartment and cannot enter the outer zone of the bag or pouch cavity. In this way the small items can be attractively displayed in a bag or pouch of significantly larger volume. The larger size of the bag or pouch facilitates handling and display and permits use of marketing and information material in or attached to the bag or pouch as part of the package.

The individual discrete small items housed within the compartment are not tightly confined but have freedom of movement, however collectively the mobility of the plurality of items may be somewhat restrained by the walls of the compartment.

I claim:

1. A package assembly comprising a package for housing and displaying small, discrete items at a point of purchase, whereby a purchaser can view and check the small items prior to purchase, comprising:

a flexible pouch having a pouch opening and a closed end remote from said pouch opening, said pouch opening communicating with a pouch cavity;

opposed portions of said opposed flexible walls of said pouch being sealed together to form an empty compartment within said pouch cavity, said compartment being disposed centrally of said pouch cavity intermediate and spaced apart form said pouch opening and said closed end;

said compartment having an entry port communicating with said pouch opening for free-fall entry of small times through said pouch opening into said empty compartment and having a closed compartment inner end in opposed relationship with said pouch opening and spaced from said closed end such that a discrete, small item housed in said compartment is disposed generally centrally within said pouch cavity, said compartment being bounded by a non-sealed outer zone of said pouch, said non-sealed outer zone extending between said closed compartment inner end and said closed end of said pouch and a mounting card member, said mounting card member having a pair of opposed card panel members and at least said pouch opening being housed between said card panel members to close said pouch opening during housing and displaying of the small discrete times at the point of purchase.

said opposed card panel members extending form a common fold towards outer opposed ends and being adhered together intermediate said fold and said opposed ends to define an inner abutment between said panel members, with a pair of panel flaps extending from said abutment, said pouch opening being disposed adjacent said abutment and said panel flaps being secured together with at least a portion of said pouch therebetween, and wherein said opposed card panel members have opposed slots therethrough, said slots defining a window for viewing a portion of said package disposed between said card panel members, said package further including a closure for said access opening comprising an elongate channel in said first wall member adjacent said access opening and an elongate rib in said second wall member adjacent said access opening, said rib being matingly receivable in, and removable from, said channel, said closure being disposed in said portion so as to be viewed at said window.

Please insert in the application claims 25 to 31 set out hereinafter:

2. An assembly according to claim 1, wherein said pouch is of a transparent flexible sheet materials, said pouch having a volume significantly greater than the volume of a single discrete small item to be housed in said compartment;

said opposed portions being sealed together at a plurality of closely spaced apart plastic weld points to define said compartment, said plastic weld points being closely spaced such that small times housed within said compartment are confined within said compartment and isolated from said outer zone.

3. An assembly according to claim 1, wherein said entry port is funnel-shaped, said compartment and entry port being of substantially symmetrical shape and located within said pouch cavity so as to extend centrally of said pouch cavity.

4. An assembly according to claim 1, wherein said entry port is funnel-shaped having an inverted frustoconical wall extending centrally inwardly of said pouch opening.

5. An assembly according to claim 4, wherein the opposed sealed portions comprise a plurality of closely spaced apart plastic weld points separated by non-sealed passages extending between said compartment and said outer zone, said plastic weld points being closely spaced such that small times housed within said compartment are confined within said compartment and isolated form said outer zone.

6. An assembly according to claim 4, wherein said empty compartment has a volume capacity significantly greater than the volume of a single discrete small time of a plurality to be housed within said empty compartment, and a volume capacity relative to the volume occupied by the plurality of discrete small items such that the discrete small items of a plurality within the compartment have freedom of movement under a condition of restrained mobility.

7. An assembly according to claim 1, further including a plurality of small, discrete items in said compartment, said pouch having a volume significantly greater than the volume of a single discrete small time of the plurality of times housed in said compartment.

8. An assembly according to claim 1, wherein said closed compartment inner end defines a floor edge for supporting an item contained in said compartment generally centrally within said pouch cavity in position to the force of gravity when said package assembly is hung for display.

* * * * *